US012774153B2

(12) United States Patent
Wanigaratne

(10) Patent No.: US 12,774,153 B2
(45) Date of Patent: Oct. 27, 2026

(54) STORAGE SYSTEM

(71) Applicant: Bimal Wanigaratne, Applecross (AU)

(72) Inventor: Bimal Wanigaratne, Applecross (AU)

( * ) Notice: Subject to any disclaimer, the term of this patent is extended or adjusted under 35 U.S.C. 154(b) by 184 days.

(21) Appl. No.: 18/571,908

(22) PCT Filed: Jul. 1, 2022

(86) PCT No.: PCT/AU2022/050688

§ 371 (c)(1),
(2) Date: Dec. 19, 2023

(87) PCT Pub. No.: WO2023/279145

PCT Pub. Date: Jan. 12, 2023

(65) Prior Publication Data

US 2024/0286826 A1 Aug. 29, 2024

(30) Foreign Application Priority Data

Jul. 5, 2021 (AU) ..... 2021902043

(51) Int. Cl.
*B65D 88/10* (2006.01)
*B65D 88/02* (2006.01)
(Continued)

(52) U.S. Cl.
CPC ..... *B65D 88/10* (2013.01); *B65D 88/027* (2013.01); *B65D 90/06* (2013.01); *E03B 3/03* (2013.01);
(Continued)

(58) Field of Classification Search
CPC ... E03B 3/03; E03B 11/02; E03B 3/02; B65D 88/10; B65D 88/027; B65D 1/42;
(Continued)

(56) References Cited

U.S. PATENT DOCUMENTS 5,356,589 A * 10/1994 Sugalski ..... B29C 41/46 264/269
6,193,099 B1 * 2/2001 Garton ..... B29C 41/20 220/675

(Continued)

FOREIGN PATENT DOCUMENTS

| | | | |
|---|---|---|---|
| AU | 2007100336 | A4 | 6/2007 |
| AU | 2009201318 | A1 | 10/2009 |
| AU | 2016203935 | A1 | 1/2018 |

OTHER PUBLICATIONS

Search Report dated Sep. 26, 2022 for corresponding International Application No. PCT/AU2022/050688, 6 pages.

*Primary Examiner* — Nathan J Jenness
(74) *Attorney, Agent, or Firm* — MH2 Technology Law Group, LLP

(57) ABSTRACT

A storage system comprising one or more storage units having a body comprising an inner frame, and an outer frame defining an inner space, at least one portion of the inner frame being located within the inner space defined by the outer frame, wherein at least one or more particular portions of the inner and outer frame are adapted to be attached to each other providing reinforcement to at least some portions of the outer frame. The body of the storage unit comprises walls and a roof attached to each other for defining an inner space within the body, the walls and the roof comprising indentations extending into the inner space, wherein the indentations define counterpart fastening means for receiving fastening means. There is also provided a bracket system for attachment to the counterpart fastening means permitting attaching cladding to the walls of the storage units.

25 Claims, 16 Drawing Sheets

(51) Int. Cl.

| | |
|---|---|
| ***B65D 90/06*** | (2006.01) |
| ***E03B 3/03*** | (2006.01) |
| ***E03B 11/00*** | (2006.01) |
| ***E03B 11/02*** | (2006.01) |

(52) U.S. Cl.
CPC ..... *E03B 11/02* (2013.01); *E03B 2011/005* (2013.01)

(58) Field of Classification Search
CPC . B65D 1/44; B65D 1/46; B65D 11/22; B65D 11/26
See application file for complete search history.

(56) References Cited

U.S. PATENT DOCUMENTS

| | | | | |
|---|---|---|---|---|
| 2018/0093822 | A1* | 4/2018 | Waudby | E03B 3/03 |
| 2019/0002196 | A1* | 1/2019 | Lucas | B65D 90/022 |
| 2019/0126513 | A1* | 5/2019 | Snelling | B29C 41/42 |
| 2019/0128619 | A1* | 5/2019 | Snelling | B29C 33/04 |
| 2022/0305905 | A1* | 9/2022 | Beysel | B60K 15/073 |
| 2024/0383633 | A1* | 11/2024 | Hixson | B65D 1/46 |

* cited by examiner

STORAGE SYSTEM

CROSS-REFERENCE TO RELATED APPLICATIONS

This application is a national stage application of PCT/AU2022/050688 filed 1 Jul. 2022, which claims priority to Australian Patent Application No. 2021902043 filed 5 Jul. 2021, the entire disclosures of each application are herein incorporated by reference.

TECHNICAL FIELD

The present invention relates to storage systems, in particular fluid storage systems.

The invention has been devised particularly, although not necessarily solely, in relation to fluid storage systems in the form of one or more storage units adapted for collection of rainwater and adapted to be fluidly connected with respect to each other.

The invention has also been devised particularly, although not necessarily solely, in relation to storage systems for holding water from rain or water bores primarily for domestic purposes with potential commercial purposes where the storage systems can be scaled up or down to the required or desired storage volume and configured to suite, for example, aesthetic requirements ensuring that the storage systems are aesthetically appealing.

BACKGROUND ART

The following discussion of the background art is intended to facilitate an understanding of the present invention only. The discussion is not an acknowledgement or admission that any of the material referred to is or was part of the common general knowledge as at the priority date of the application.

Fresh water is one of the most fundamental needs, for domestic use and consumption such as irrigation. The disruptions in current whether patterns, is causing water shortages for such use. Therefore, the need to a secure an otherwise a run-off water source from urban areas such as a roof collected rainwater is becoming increasingly important. This is particularly becoming evident in current highly populated arid regions in Australia, Asia, Africa, South America and the US.

With the impact of climate change leading to reduced rain fall in traditional municipal water catchment areas, increased emphasis is required to entice people to capture as much of the rainwater falling on dwelling roofs in populated urban regions of the world and to use this for domestic purposes such as irrigation. Thereby helping to reduce water demand from municipality supplies.

At present the large volumes of rainwater falling in urban arid regions is not captured and in most cases is diverted into storm water rains due to lack of suitable and appropriate rainwater capture and storage facilities that can be installed in urban area dwellings.

With recent advances in plastic moulding technology, rainwater tanks of various sizes, primarily cylindrical in nature to be purchased to capture rainwater falling on dwelling roofs in urban areas. Cylindrical tanks are particular useful, in particular due to their walls being able to resist deformation due to forces exerted by the hydrostatic load of the fluid contained in the tank. However, cylindrical tanks typically, due to their curved walls occupy a larger space than, for example, a cubical or rectangular shaped tank with straight walls. This is particularly true when fluid storage systems made out of a plurality of cylindrical tanks are fluidly joined together; in fact, the curved walls of the cylindrical tanks when joined side by side do not define a storage system as compact as is the case when locating side by side cubical or rectangular tanks having straight walls. However, the straight walls of the cubical or rectangular tanks are prone to be deformed due to the hydrostatic pressure exerted from inside of the tank.

Further, one issue with the currently available plastic type rainwater tanks are aesthetics and the lack of modular scalability. Given, the difficulty placing sufficient capacity water tanks into current urban smaller back yards of modern urban dwellings, together with issues of aesthetics and the associated high installation cost is detracting people who would otherwise consider placing rainwater tank systems in their back yard in current urban settings.

This is creating a need for an aesthetically customisable and modular scalable tank system that can be installed without the need for heavy load handling equipment against a dwelling's walls or back yard fence without taking too much space and to provide the flexibility to expand as and when required and to provide the optionality to clad the tanks in an aesthetically acceptable manner such that they do not look like the plastic round/rectangular tanks that are commercially available at present.

It is against this background that the present invention has been developed.

SUMMARY OF INVENTION

According to a first aspect of the invention there is provided a storage unit having a body comprising an inner frame, and an outer frame defining an inner space, at least one portion of the inner frame being located within the inner space defined by the outer frame, wherein at least one or more particular portions of the inner and outer frame are adapted to be attached to each other providing reinforcement to at least some portions of the outer frame.

Preferably, attachment between the one or more portions of the inner and outer frame occurs via kiss-off features.

Preferably, the kiss-off features are formed during casting by powdered plastic material bridging one or more gaps between at least one or more particular portions of the inner and outer frame.

Preferably, the outer frame comprises end walls, side walls, and lower bottom and upper roof defining the inner space.

In a particular arrangement, reinforcement of at least some portions of the outer frame occurs by attaching particular portions of reinforcements means of the outer frame to each other.

Preferably, the reinforcement means comprises indentations indenting into particular areas of the outer frame. Preferably, the reinforcement means comprise a first set of indentations indenting into the side walls, and a second set of indentations indenting into the end walls.

Preferably, indentations of the first set of indentations comprises first ends located within the outer frame and indentations of the second sets of indentations comprises second ends located within the outer frame, wherein counterpart first ends and second ends are bridged together during casting forming a kiss-off feature.

Preferably, the first set of indentations comprise rectangular parallelepipeds.

Preferably, the second set of indentations comprise a trapezohedrons.

Preferably, the at least one portions comprise corners of the indentations.

Preferably, the first set of indentations comprise a plurality of rectangular parallelepipeds arranged in a spaced apart relationship with respect to each other along the side wall.

Preferably, there are pairs of rectangular parallelepipeds spaced apart a particular spacing with respect to each other.

Preferably, the spacing for one pair of rectangular parallelepipeds is not the same spacing than the spacing of another pair of rectangular parallelepipeds.

Preferably, the pair of rectangular parallelepipeds are arranged with respect to each other in such a manner so as to provide an enhanced reinforcement.

Preferably, the second set of indentations comprise a plurality of trapezohedrons arranged in a spaced apart relationship with respect to each other along the side wall.

Preferably, there are pairs of trapezohedrons spaced apart at particular spacing with respect to each other.

Preferably, the spacing for one pair of trapezohedrons is not the same spacing than the spacing of another pair of trapezohedrons.

Preferably, the pair of trapezohedrons are arranged with respect to each other in such a manner so as to provide an enhanced reinforcement.

Preferably, the storage unit is adapted to be fluidly connected to an exterior source of fluid, such as rainwater or borewater.

Preferably, the storage unit is adapted to be fluidly connected to one or more other storage units.

Preferably, the storage unit further comprises a piping system for fluidly connecting neighbouring storage units.

Preferably, the storage unit further comprises one or more recesses for receiving the piping system.

Preferably, the recesses are located at the lower bottom of the storage unit.

Preferably, the storage unit comprises cladding covering the side and end walls.

Preferably, the storage unit comprises a roof structure.

Preferably, the body of the storage unit is casted in a rotational mould.

According to a second aspect of the invention there is provided a storage unit having a body comprising walls and a roof attached to each other for defining an inner space within the body, the walls and the roof comprising indentations extending into the inner space, wherein the indentations define counterpart fastening means for receiving fastening means.

Preferably, the indentations are defined within a mould during casting of the body of the storage unit via protrusions extending from inner surfaces of the mould.

According to a third aspect of the invention there is provided a storage unit having a body comprising walls and a bottom attached to each other for defining an inner space within the body, wherein the bottom comprises a recess indenting into at least one wall defining an opening to provide access to pipping fluidly connected to the inner space.

According to a fourth aspect of the invention there is provided a storage system comprising one or more storage units according to the third aspect of the invention, and at least one niche adapted to receive a connection system, wherein the niche is defined by the recesses of the storage units in accordance with the third aspect of the invention when the storage units are located side by side.

According to a fifth aspect of the invention there is provided a storage system comprising one or more storage units according to the first and second aspect of the invention.

According to a sixth aspect of the invention there is provided a first holding bracket for attachment of first cladding to a first wall, the first holding bracket comprising a first sheet having a plurality of first slots extending transversally along the first sheet and adapted for attachment of the first holding bracket to a second wall attached to the first wall, and a second sheet having a second slot extending longitudinally along the second sheet, the second slot being adapted to attach the holding bracket to the first wall, wherein the second sheet is adapted to attach the first cladding to the first holding bracket.

Preferably, the first holding bracket is adapted to define a clearance between the cladding and first wall.

According to a seventh aspect of the invention there is provided a second holding bracket for attachment of second cladding to a second wall, the second holding bracket comprising a first sheet having a third slot extending longitudinal along the first sheet and a second sheet being adapted to attach the second cladding to the second holding bracket, wherein the first sheet of the second holding bracket is adapted to be attached to the second wall.

According to an eight aspect of the invention there is provided a bracket system for attaching a plurality of cladding to first and second walls attached to each other, the bracket system comprising the first holding bracket in accordance with the sixth aspect of the invention and the second holding bracket in accordance with the seventh aspect of the invention in order to attach the first and second claddings adjacent to each other, the first holding bracket and the second holding bracket being adapted to be operatively joined to each other to allow slideable movement with respect to each other.

Preferably, the first, second and third slots are adapted to allow displacement of the first and second holding bracket along the first and second wall to account for any variations in the locations of counterpart means used for attaching the cladding to the first and second walls.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

The figures depict embodiments of the present invention for purposes of illustration only. One skilled in the art will readily recognise from the following discussion that alternative embodiments of the structures and methods illustrated herein may be employed without departing from the principles of the invention described herein.

DESCRIPTION OF EMBODIMENT(S)

FIGS. 1 to 11 show a particular arrangement of a storage system 10 in accordance with an embodiment of the invention. The storage system 10 is particularly useful for storage of fluids such as water, in particular rainwater or borewater.

In accordance with a particular arrangement, the storage system 10 is adapted to be fluidly connected to a rainwater collection unit permitting receiving the rainwater from, for example, dwellings roofs and storage thereof within the storage system 10.

Figure 1:
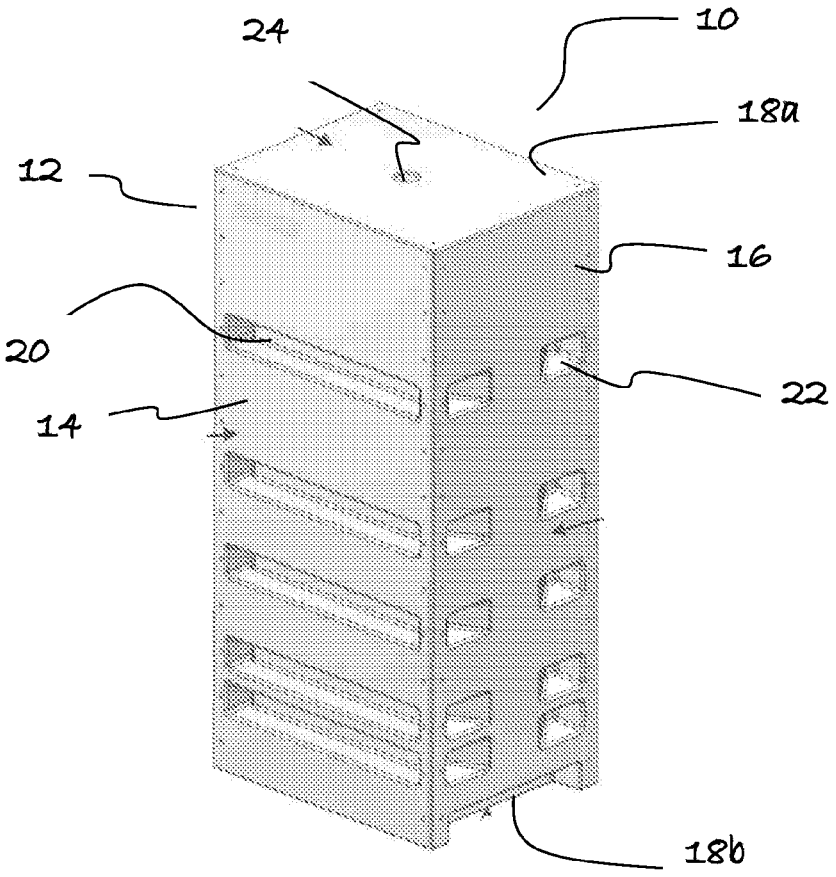
FIG. 1 is a perspective view of a particular arrangement of a storage system in accordance with an embodiment of the invention.
Figure 6:
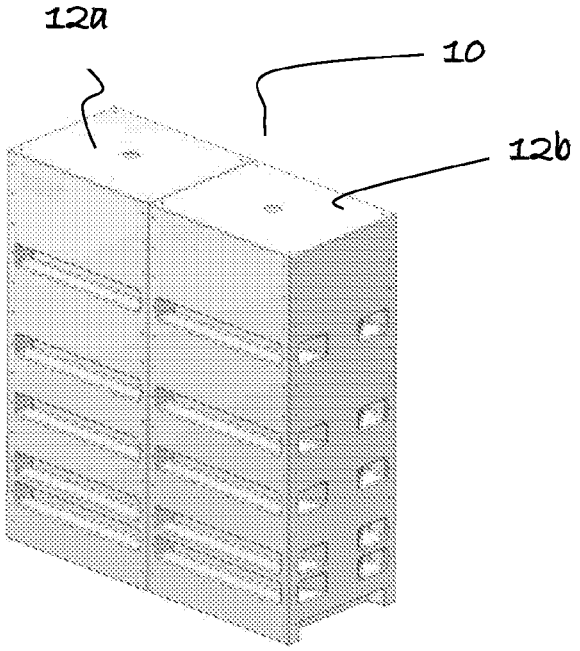
FIGS. 6 and 7 are perspective views of particular arrangements of storage systems comprising a plurality of storage systems shown in FIG. 1.
Figure 7:
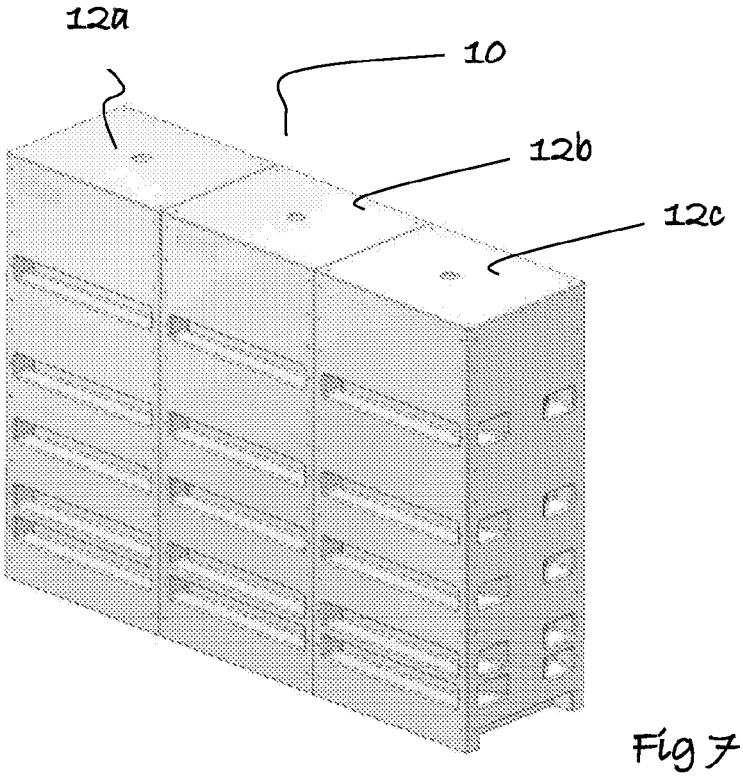

The storage system 10 in accordance with the present embodiment of the invention may comprise more than one of the storage units 12 as shown in FIGS. 1, 6 and 7. The storage units 12 are adapted to be fluidly connected with respect to each other; this is particularly useful because, in this manner the storage system 10 in accordance with the present embodiment of the invention may be scalable (increasing/decreasing its size by adding/removing additional storage units) depending on the space available at a particular location where the storage system will be located and the amount of fluid that is expected to be collected at the particular location.

Further, each storage unit 12 is adapted to be aesthetically enhanced in order to ensure the aesthetical appearance of the location, where the storage system 10 will be located, will not be compromised by locating unappealing conventional plastic tanks, as currently is the case.

Furthermore, in accordance with the present embodiment of the invention, particular arrangements of the storage units 12 are adapted to reinforce the wall structures (in particular, the end and side wall structures) of the tank units 12 to reduce wall deformation produced by hydrostatic loading due to the fluid (such as rainwater) contained within the storage units 12.

In an arrangement, the storage units 12 comprises an inner frame and an outer frame. The outer frame defines an inner space, formed in this particular arrangement, by the end walls 16, side walls 14, and lower bottom 18*b* and upper roof 18*a* of the storage units 12 depicted in FIG. 1. The inner frame being located (at least on some portions of the inner frame) within the inner space defined by the outer frame.

The inner frame and the outer frame are adapted to be attached with respect to each other. In particular, at least one or more particular portions of the inner and outer frame are attached to each other providing reinforcement to at least some portions of the outer frame such as, for example, the end and side walls 16 and 14.

In a particular arrangement of the present embodiment of the invention, the reinforcement of the side and end walls occurs by attaching particular portions of reinforcements means of the outer frame, such as the indentations 20 and 22, to each other. Examples of the particular portions are the corners 34 and 42 of the indentations 22 and 20 as depicted in, for example, FIGS. 3*b* and 11*e*.

Referring now to FIGS. 1 to 4, as shown in FIG. 1, the storage system 10 may comprise a single storage unit 12.

The storage unit 12 comprises a body of rectangular shape having side walls 14, end walls 16, and upper roof 18*a* and a lower bottom 18*b* defining the space for containment of the fluid such as water.

The side walls 14 and end walls 16 comprise a plurality of indentations 20 and 22 arranged in a spaced apart relationship with respect to each other.

Figure 2:
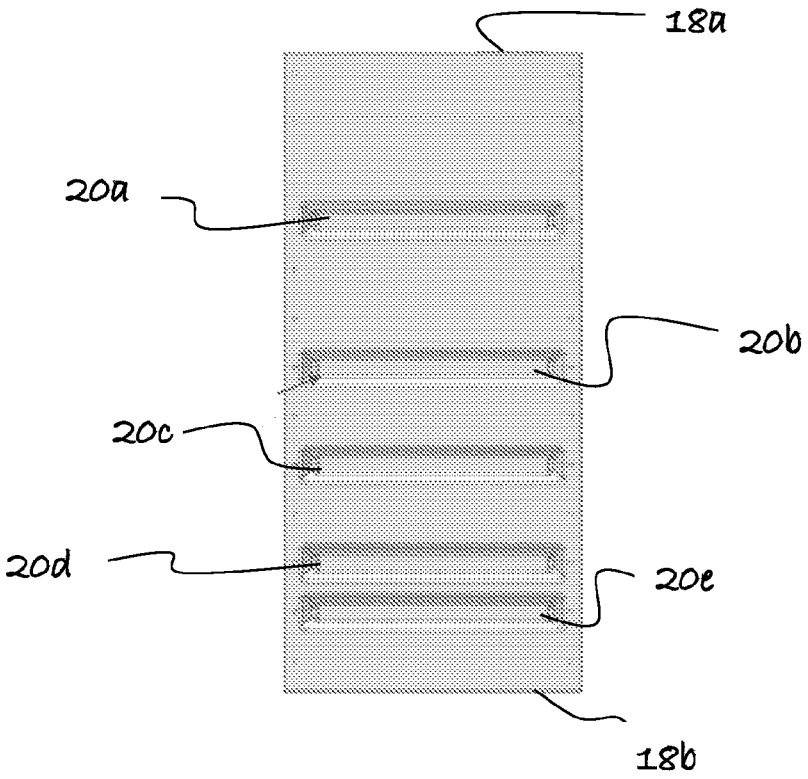
FIG. 2 is a side view of the storage system shown in FIG. 1.

As shown, for example, FIG. 2, each indentation 20 of each side wall 14 are of rectangular configuration (such as rectangular parallelepiped) with its long side extending from one end wall 16*a* to the other end wall 16*b*.

The end walls 16 comprise a set of two indentations 22 located side by side with a plurality of sets of two indentations 22 extending between the upper roof 18*a* and lower bottom 18*b*.

Figure 3A:
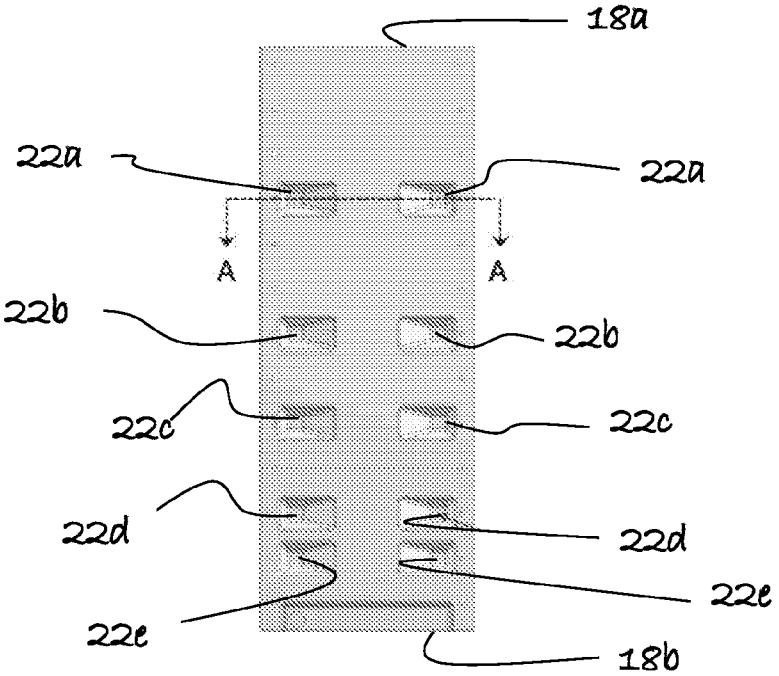
FIG. 3*a* is an end view of the storage system shown in FIG. 1.
Figure 3B:
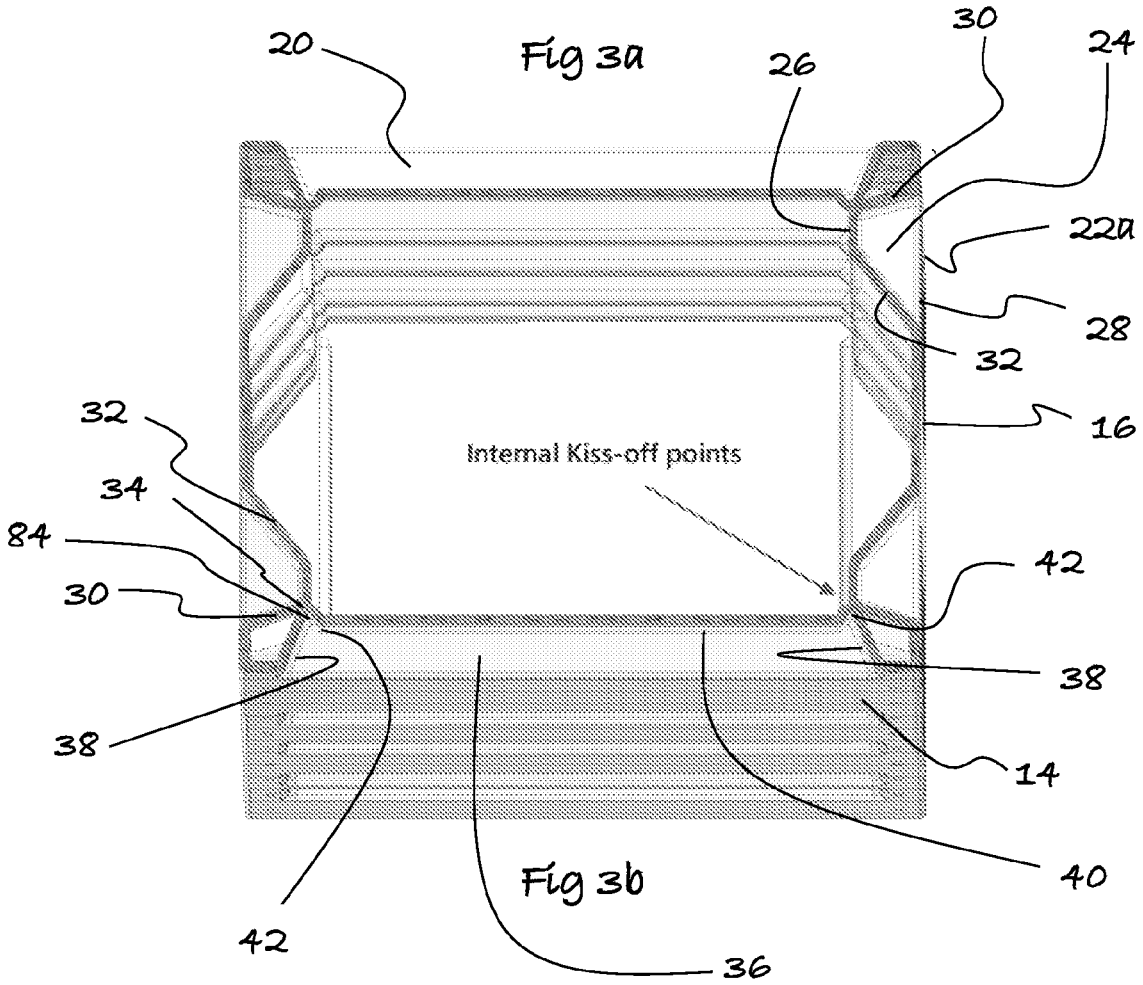
FIG. 3*b* is a top view of a cross section of the storage system along the plane A-A shown in FIG. 3*a;*

As shown best in FIG. 3*b*, each indentation 22 is configured as a three-dimensional trapezoid 24 (also referred to as trapezohedron) indenting into the end wall 16 such that the smaller base 26 of the three-dimensional trapezoid 24 is located within the interior of the storage unit 12 and its larger base 28 is flush with the outer surface of the end wall 16. The larger base 28 defines the opening of the indentation 22.

The three-dimensional trapezoid 24 comprises a short side 30 and a long side 32. The three-dimensional trapezoid 24 is configured in such a manner that the short side 30 is located proximal to the side wall 14 and the long side 32 is distal from the side wall 14. As will be described with reference to the method for reinforcing the side walls 14 and end walls 16 of each storage unit 12, reinforcing of the walls 14 and 16 is accomplished by joining together portions of the indentations 20 and 22 that are within the storage unit 12. In particular, the corner 34 (defined by the short side 30 and the smaller base 26 of the three-dimensional trapezoid 24) is joined together to the corner 42 of the rectangular parallelepiped 36 defined by the indentation 20—see FIG. 3*b*. As shown in FIG. 3*b*, the indentation 20 defines a rectangular parallelepiped 36 within the inner space of the storage unit 12 having side walls 38 and an end wall 40 joined together to define corners 42 defined by the side wall 38 joining the end wall 40.

Furthermore, referring back to FIGS. 2 and 3*a*, the spacing between neighbouring indentations 20 and 22 differs for each pair of neighbouring indentations 20 and each pair of neighbouring sets of two indentations 22. In particular, as shown in FIGS. 2 and 3*a*, the pairs of indentations 20 and the pair of sets of two indentations 22 that are located proximal to the lower bottom 18*b* of the storage unit 12 are located closer with respect to each other than the pair of indentations 20 and the pair of sets of two indentations 22 located proximal to the upper roof 18*a*.

The quantity of pair of indentations 20 and the set of two indentations 22 and the spacing between them as depicted in FIGS. 2 and 3*a* is one particular arrangement. In accordance with alternative arrangements, the quantity of pair of indentations 20 and the pair of sets of two indentations 22 and the spacing between them may be varied to, for example, increase or decrease the strength of the side and end walls 14 and 16 of the storage unit. By increasing or decreasing the quantity and/or the spacing between the indentations 20 and the set of two indentations 22 it is possible to adjust the magnitude of the reinforcement provided by the junction (also referred to as the kiss-off feature) formed by joining together the corners 42 and 34 defined by the indentations 20 and 22 as was defined above with reference to FIG. 3*b* and to be describe in greater detail with reference to FIGS. 11*e* and 12.

Figure 4B:
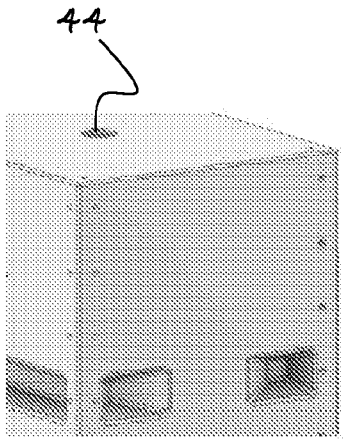
FIG. 4*b* is a detail of the upper end of the storage system shown in FIG. 4*a;*
Figure 4A:
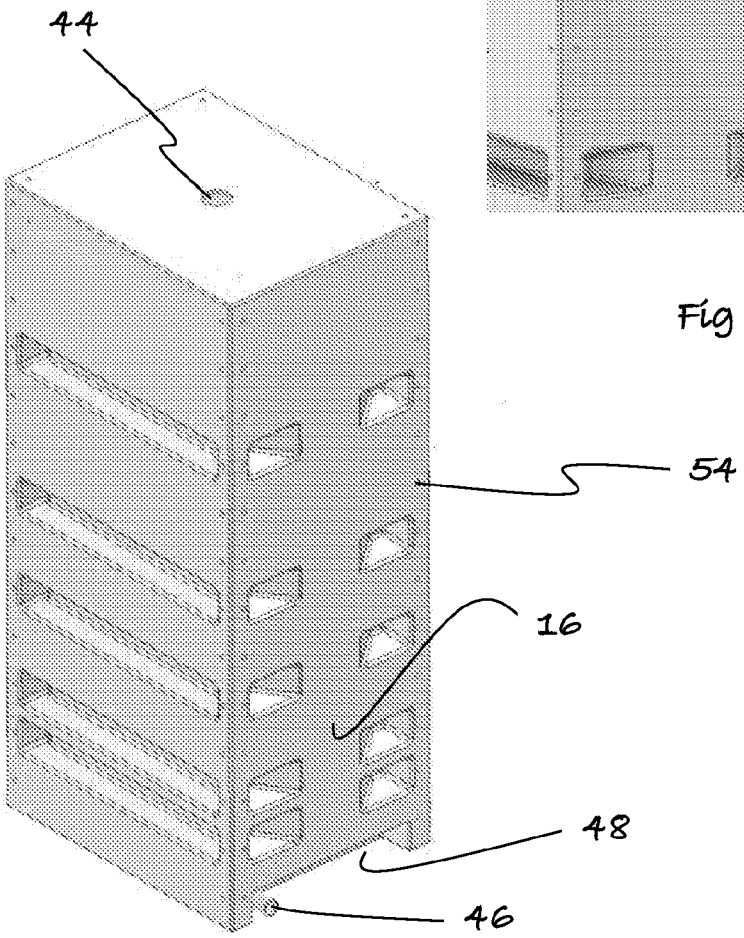
FIG. 4*a* is a perspective view of the storage system shown in FIG. 1.

Referring now to FIGS. 4*a* and 4*b*, as mentioned before, the storage system 10 is adapted to be fluidly connected to a rainwater collection unit system. For this, the upper roof 18*a* of each storage unit 12 comprises an inlet 44 permitting the tank unit 12 to be fluidly connected to a water source such as a water collection system of a dwelling.

Figure 5B:
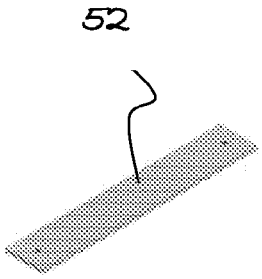
FIG. 5*b* is a perspective view of an example of cladding element of the storage system shown in FIG. 5*a;*
Figure 5A:
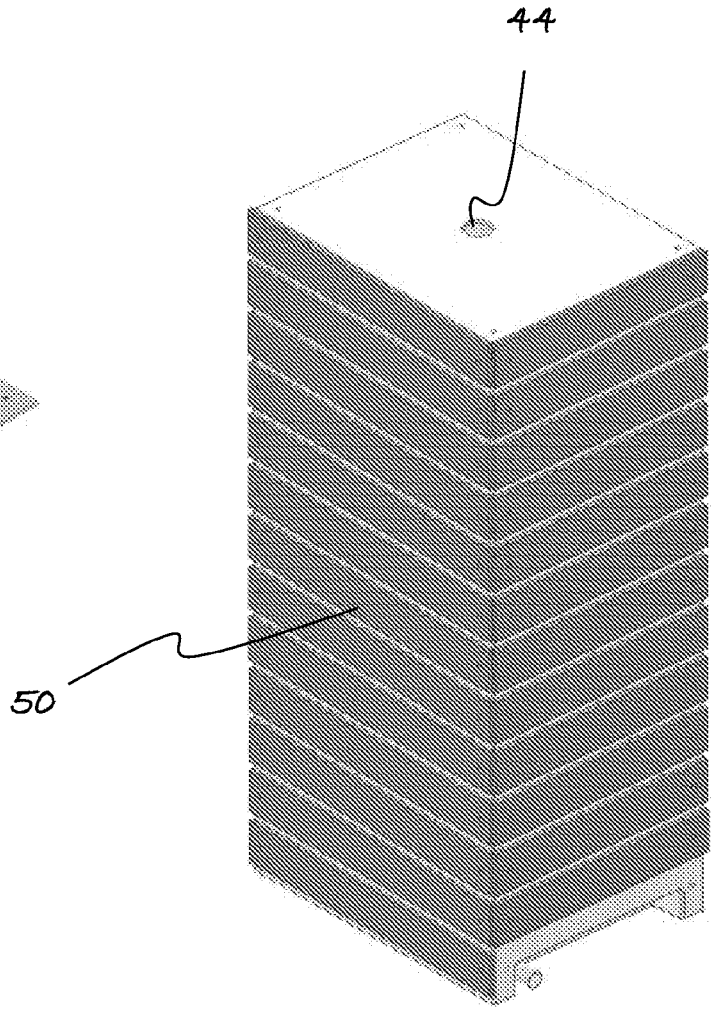
FIG. 5*a* is a perspective view of the storage system shown in FIG. 1 including cladding on its side walls and end walls.

Referring now to FIGS. 5*a* and 5*b*, as mentioned before each storage unit 12 is adapted to be aesthetically enhanced. For this, the side walls 14 and the end walls 16 are adapted to receive cladding 50 covering the surface of the walls 14 and 16 as shown in FIGS. 5*a* and 5*b*.

In the particular arrangement shown in FIGS. 5*a* and 5*b*, the cladding 50 is defined by attaching a plurality of cladding boards 52 to the outer surface of the walls 14 and 16 via fastening means, such as screws. The side walls 14 and 16 comprise counterpart fastening means 54 for receiving the fastening means (e.g. screws) that attach the cladding boards 52 to the side walls 14 and 16. The counterpart fastening means 54 comprise indentations 55 (see FIG. 4) for receiving the fastening means (such as screws) for attachment of the cladding boards 52. The indentations 55 are formed during casting of the body of the storage unit 12 via protrusions 88 (see FIG. 11*e*) that extend from the inner surface of the mould 70 into the inner space of mould 70. In particular arrangements, the counterpart fastening means 54 may be adapted to receive the screws by including nut means for receiving the screws inside the indentations 55.

Figure 5C:
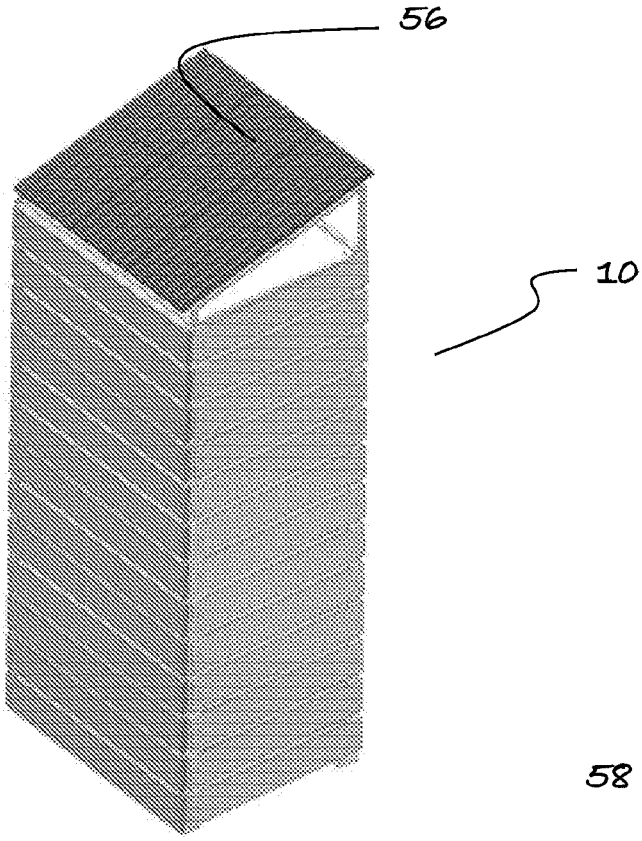
FIG. 5*c* is a perspective view of the storage system shown in FIG. 5*a* including a roof assembly.
Figure 5D:
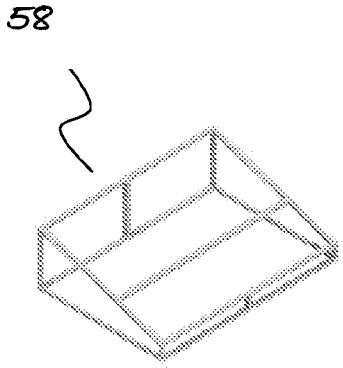
FIGS. 5*d* and 5*e* are perspective views of the roof assembly shown in FIG. 5*c* in disassembled condition.
Figure 5E:
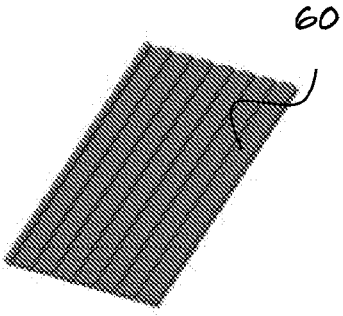

Referring now to FIGS. 5*c* to 5*e*, the storage system 10 may comprise also a roof structure 56. The roof structure 56 comprises a frame 58 for mounting on the upper roof 18*a* of a storage unit 12; and a tile structure 60 for laying onto the frame 58 with the structure being fastened via counterpart fastening means 54 on 18*a* as shown in FIG. 5*a*.

Referring now to FIGS. 4*a*, and 6 to 9, as mentioned the storage system 10 may comprise one or more storage units 12. FIGS. 6 and 7 show two particular arrangements of storage systems 10 with a plurality of storage units 12.

As shown in FIG. 4*a*, the lower bottom 18*b* of each storage unit 12 comprises piping 46 fluidly connected to the interior of the storage unit 12 and adapted to be fluidly connected to a neighbouring storage unit 12. In particular, each end wall 16, proximal to the lower bottom 18*b*, comprises a recess 48 for locating the piping 46 therein. The fact that each storage unit 12 comprises the piping 46 at each side wall 16 permits sandwiching one storage unit 12 between a pair of storage units 12 and fluidly connecting them via a piping system 62 including the piping 46 to define a storage system 10 comprising three storage units 12 as shown in FIG. 7.

The plurality of storage units 12 are fluidly connected with respect to each other. For this, the storage system 10 comprises the pipping system 62 depicted in FIGS. 8 and 9.

The piping system 62 comprises the pipping 46 of each neighbouring storage units 12 and a piping 64 joining the piping 46 of the storage units 12 together. This permits fluidly connecting the storage units 12 together allowing for a scale up or a scale down of the capacity of the internal space contained in the storage system 10 according to needs and preferences.

Figure 8:
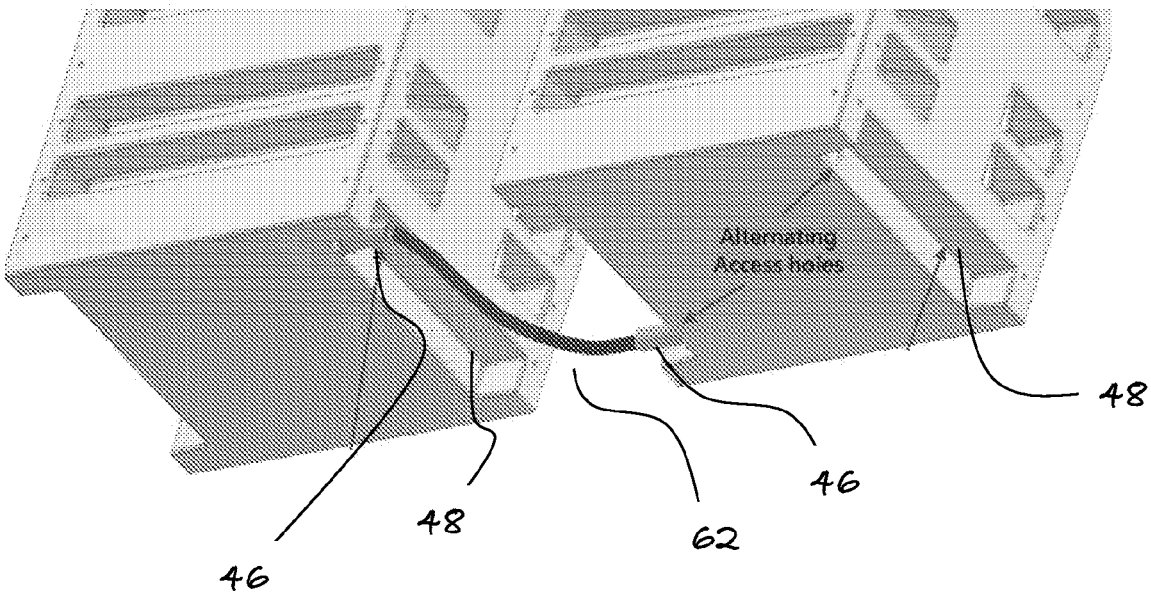
FIGS. 8 and 9 are, respectively, bottom views of the storage systems shown in FIG. 1 prior assembly, and after assembly to form the storage system in FIG. 6.

As mentioned, and shown in, for example, FIG. 8, the lower bottom 18*b* of each storage unit comprise a recess 48 indenting into the lower bottom 18*b* defining an opening 49 at each end wall 16 (of each storage unit 12) that permits joining together the piping 46 of neighbouring storage units 12 thereby providing concealed connection of the piping connection system 62. The recesses 48 due to including the opening 49 define a niche 90 when the storage units 12 are located side by side.

Figure 9:
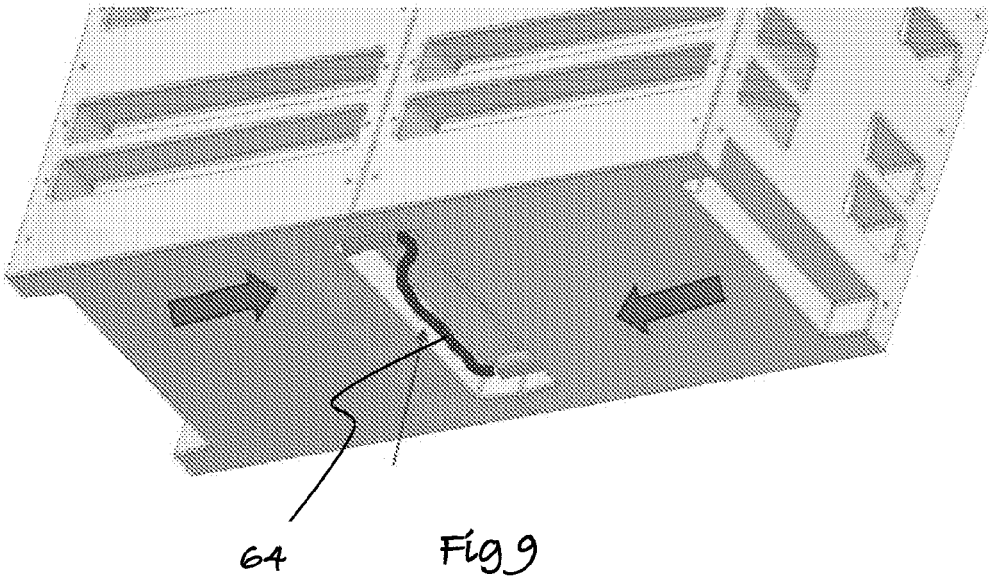

In particular, as shown in FIG. 9, upon locating the storage units 12 side by side a niche 90 is defined by both recesses 48 joined together when the ends 16*a* and 16*b* of the storage units 12 abut each other. The niche 90 is adapted to receive the piping 46 and 64 for concealment thereof.

Figure 10:
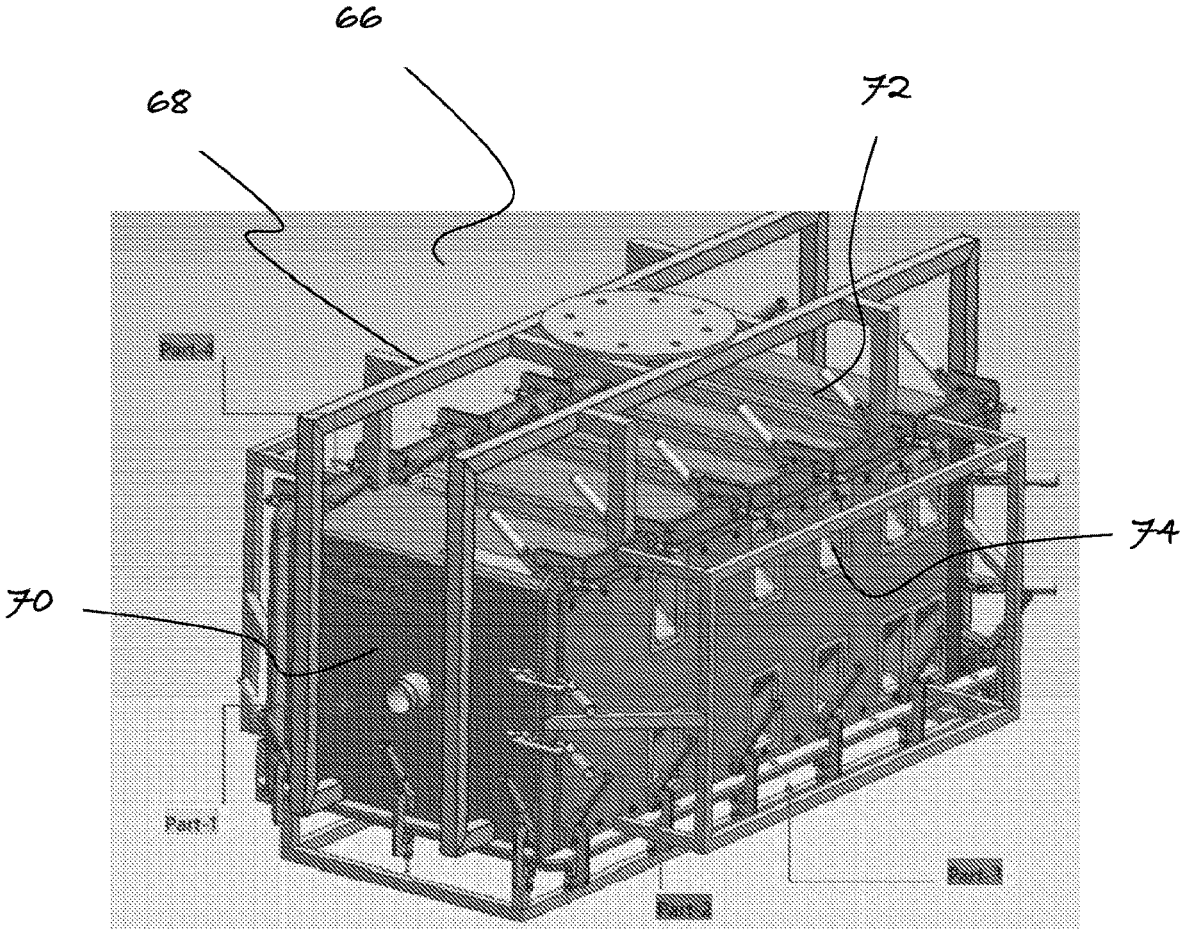
FIG. 10 is a perspective view of a rotational mould frame comprising a mould for casting the storage unit shown in FIG. 1.

Referring now to FIGS. 10 and 11, these figures depict a mould assembly 66 used for casting of the body of the storage units 12 excluding the roof structure 56 and cladding 50. In a particular arrangement, the storage units 12 are casted using rotational casting techniques.

In particular, the mould assembly 66 comprises a rotational casting frame 68 and a mould 70 arranged within the casting frame 68. The casting of each storage unit 12 occurs by inserting, for example, plastic material in the mould and start heating the mould 70 continuously. The heated mould 70, being secured within the casting frame 68, is then rotated. The melted plastic material, within the heated mould 70, is dispersed within the mould 70 and applied to the inner surfaces of the mould 70 during rotation of the mould 70. The movement of the frame 68 is kept even during the cooling process to avoid sagging and deformation of the walls that make up the storage unit 12.

As shown in FIG. 10, the mould 70 is substantially similar in external appearance to one of the storage units 12 including indentations 72, 74 on the side walls and end walls of the mould 70. The presence of the indentations 72 and 74 reaching into the mould 70 allows for forming the indentations 22 and 20 of the storage units 12.

Further, the mould 70 comprises protrusions 88 allowing the formation of the counterpart fastening means 84 54 on the walls 14 and 16 and the roof 18*a* for insertion of screws for attachment of cladding 50 and roof structure 56. The protrusions 88 extend form the inner surface of the mould 70 into the inner space of the mould 70 as shown in, for example, in FIGS. 11*c* and 11*e*.

FIG. 11 are perspective view of particular sections of the mould 70 depicting the interior of the mould 70.

Figure 11A:
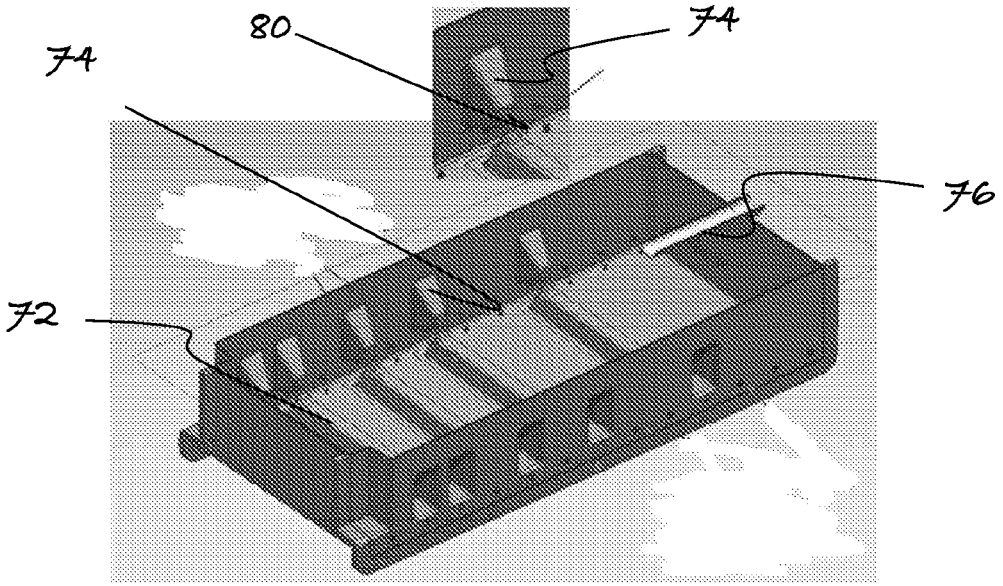
FIGS. 11*a* to 11*d* are perspective views of cross-sections of the mould for casting the storage system shown in FIG. 10.
Figure 11B:
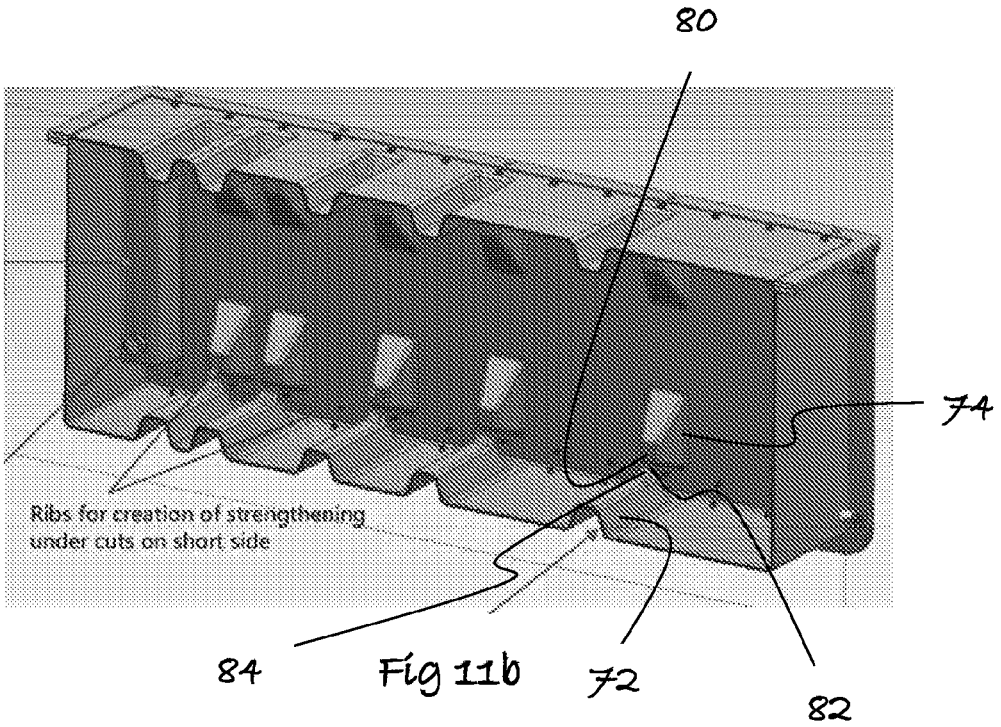
Figure 11C:
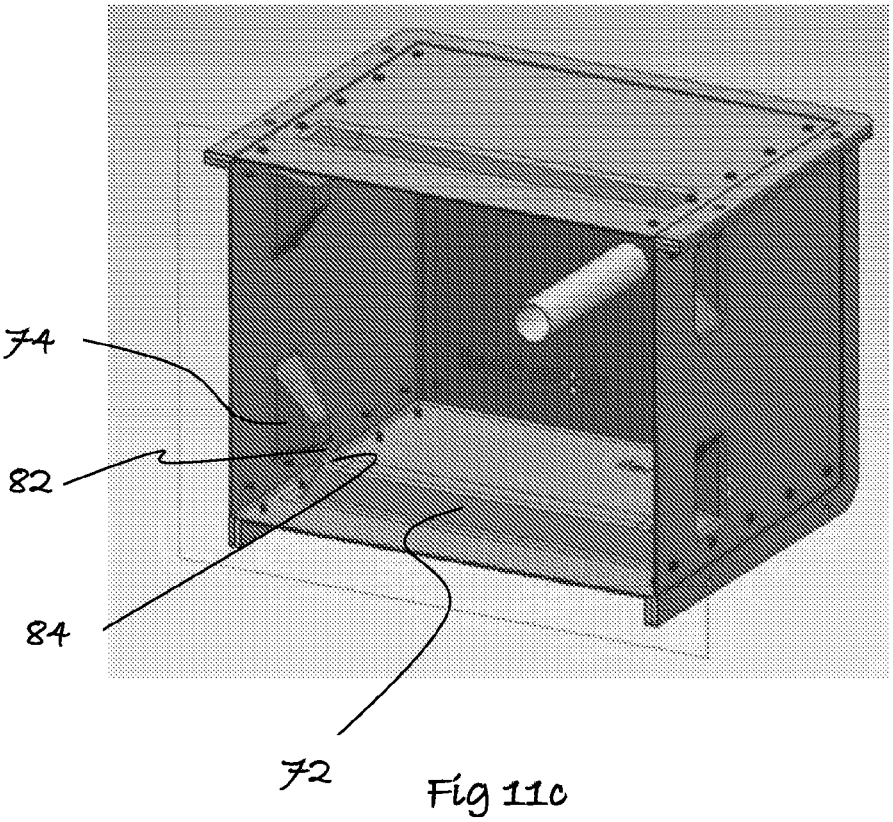

FIG. 11*a* is longitudinal cross-section of the mould 70. As shown, the mould 70 comprises a piping 76 defining the inlet 44 used for fluidly connecting the storage unit 12 with a fluid source.

Further, the indentations 72 and 74 reach into the inner space of mould 70 defining, respectively, outermost ends 78 and 80. As appreciated from, for example, FIG. 11*b* the ends 78 and 80 are spaced apart defining a gap 82 between both ends 78 and 80.

Figure 11D:
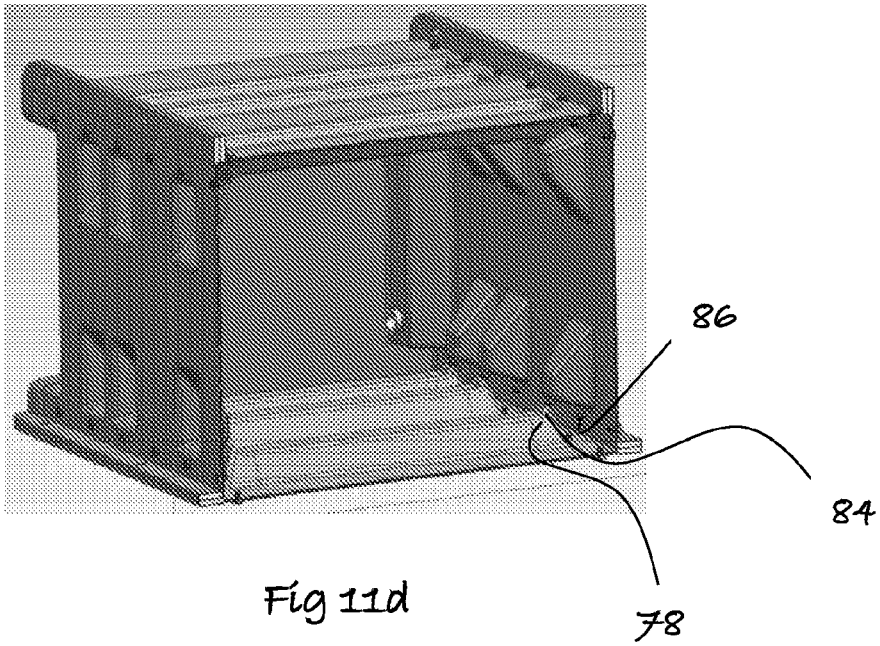
Figure 11E:
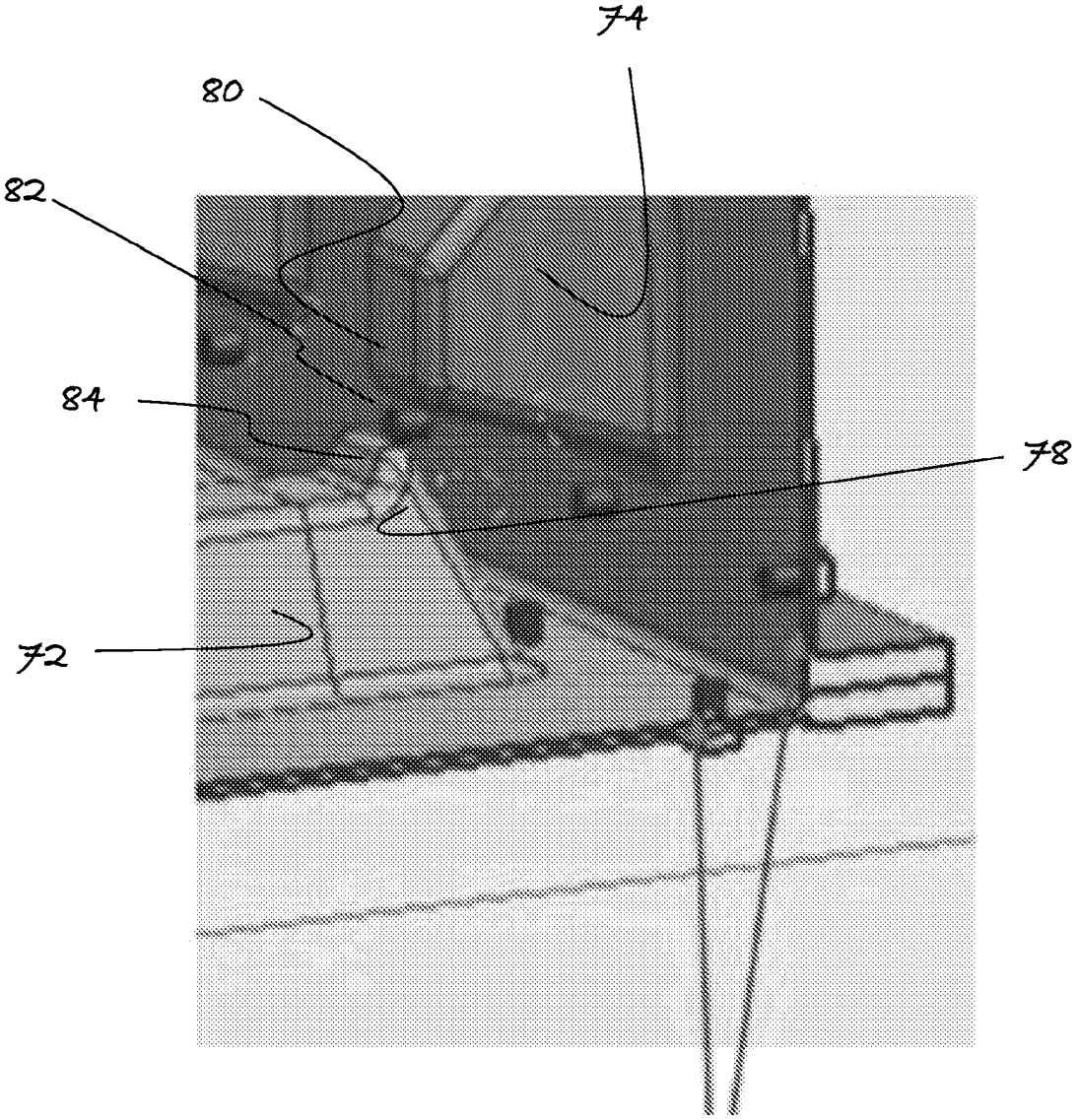
FIG. 11*e* is a detail of the lower right corner of the cross section of the mould shown in FIG. 11*d* including detail of protrusions for creation of holes to affix screws for cladding.

As best seen in FIG. 11*d* each indentation 72 comprises at their end 78, an extension 84 extending towards the end 80 of the indentation 74. The gap 82 is defined between the extension 84 and the end 80 of the indentation 74. In accordance with the present embodiment of the invention the gap 82, after casting of the storage unit 12, is filled with hardened plastic material joining together counterpart corners 42 and 34 of the indentations 20 and 22 of the storage unit 12 defining a kiss-off feature 86 from hardened plastic material that keep the corners 42 and 34 of the indentations 20 and 22 together—see FIG. 12. The kiss-off feature 86 is formed during casting; in particular, during casting the powdered plastic material bridges the gap 82 between the corners 42 and 34 of the indentations 20 and 22.

Figure 12:
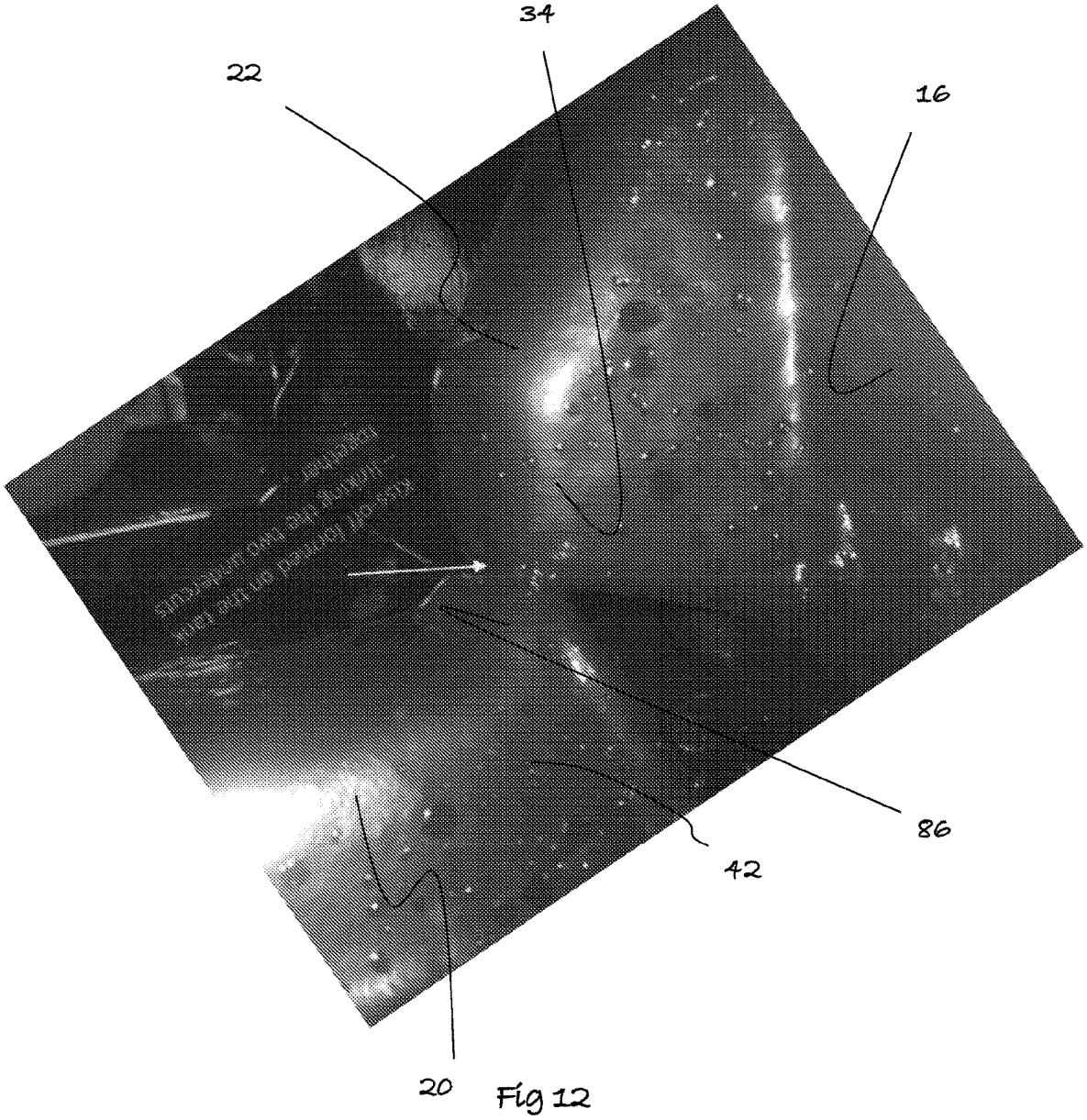
FIG. 12 is close up-view of a kiss-off feature joining together ends of the indentations made into the side and end walls of the storage unit.

As mentioned before, any deformation of the end and side walls 14 and 16 can compromise the integrity of the storage units 12, in particular their ability to hold fluid and maintaining the cladding 50 properly attached to the walls 14 and 16 via counterpart fastening means 54. The fact that the corners 42 and 34 of the indentations 20 and 22 of the storage unit 12 are kept together is particularly useful because by joining together the corners 42 and 34 of each pair of indentations 20 and 22, the side and walls 14 and 16 of the storage unit 12 are impeded from deforming when in use containing a fluid that applies a force against the side and end walls 14 and 16. FIG. 12 shows a close up view of the kiss-off feature 86 defined when joining together the ends of the indentations 20 and 22 of the storage unit 12.

The counterpart fastening means 54 comprising indentations and, if applicable, counterpart threads for receiving the fastening means (such as screws) that attach the cladding boards 52 onto the end and side walls 14 and 16 and the roof structure 58 to 18*a* of the storage units 12. The indentations of the counterpart fastening means 54 are defined during the casting process via the protrusions 88 see FIGS. 11*c* and 11*d*, for example) that reach into the inner space of the mould 70.

Referring now to FIGS. 13 to 19, FIGS. 13 to 19 related to a bracket system 91 in accordance with the present embodiment of the invention adapted for attaching the cladding 50 to the walls 14 and 16 of the storage unit 12.

The bracket system 91 (see FIGS. 15, 18 and 19) is adapted to allow attachment of the cladding 50 to walls 14 and 16 of the storage unit 10, in particular to facilitate attachment of cladding 50 to the storage units 12. For example, during manufacture of the storage units 12, using rotational moulding manufacturing process, slight variations in the storage units 12 may occur, in particular the locations of counterpart fastening means may vary when compared to other storage units 12 manufactured using the same rotational moulding process and mould. These variations may pose a problem for attaching cladding 50 that have fixed pre-determined dimensions. On occasions the counterpart fastening means 54 (used for attaching the cladding 50) may not have been formed in the proper location impeding properly attaching the cladding 50 of fixed pre-determined dimensions.

Figure 15:
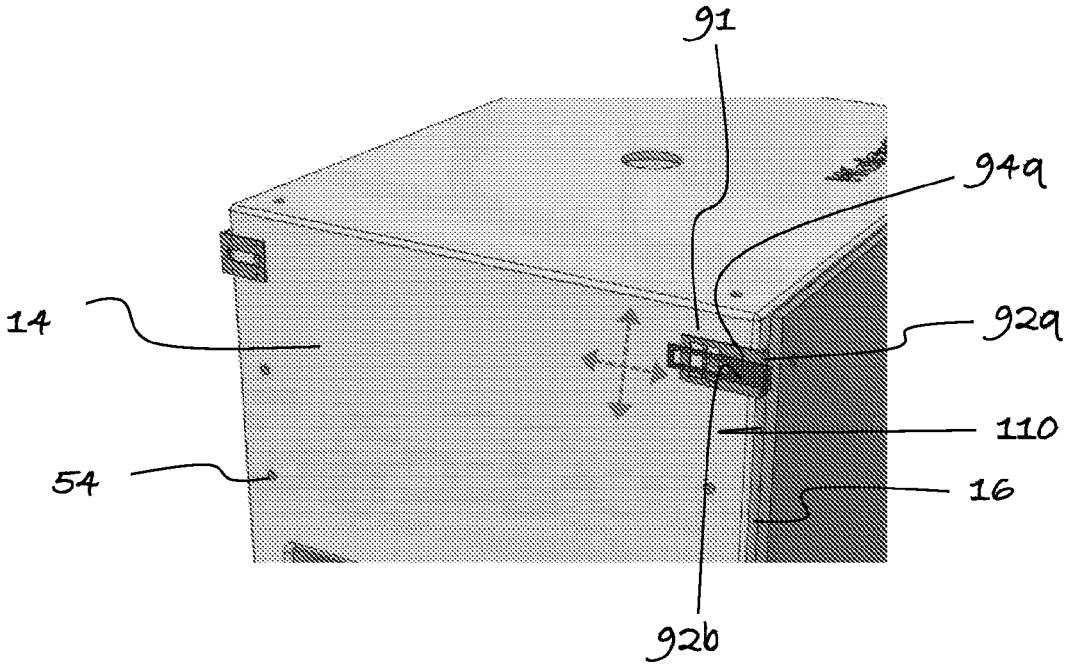
FIG. 15 is a perspective view of the storage unit shown in FIG. 13 with one of the claddings removed from the storage unit exposing the bracket system in accordance with the present embodiment of the invention.
Figure 17:
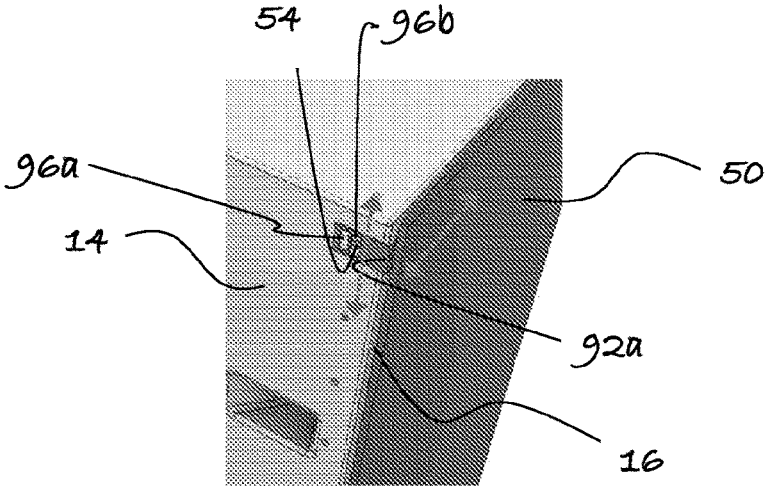
FIG. 17 shows a close-up of detail B shown in FIG. 16.

To remedy the variations in the locations of the counterpart fastening means 54, the bracket system 91 is adapted to displace a plurality of holding brackets 92, part of the bracket system 91, along the walls 14 and 16 to account for any variations in the locations of the counterpart fastening means 54 that impedes attaching the cladding 50 of fixed pre-determined dimensions to the walls 14 and 16. Displacement along the walls 14 and 16 include sliding the holding brackets 92, for example, up and down (as illustrated in FIGS. 15 and 17) with respect to the surfaces of the walls 14 and 16.

In a particular arrangement, the bracket system 91 comprises a pair of holding brackets 92*a* and 92*b*. These holding brackets 92 are adapted to work together to permit attaching the cladding of fixed pre-determined dimensions to any storage unit 12 even though, due to deficiencies intrinsic to the rotational moulding manufacturing process, the counterpart fastening means 54 may not be always located at the precise locations that would permit attaching the cladding 50 to the walls 14 or 16 of the storage unit 12 without the help of the bracket system 91 in accordance with the present embodiment of the invention.

Figure 18:
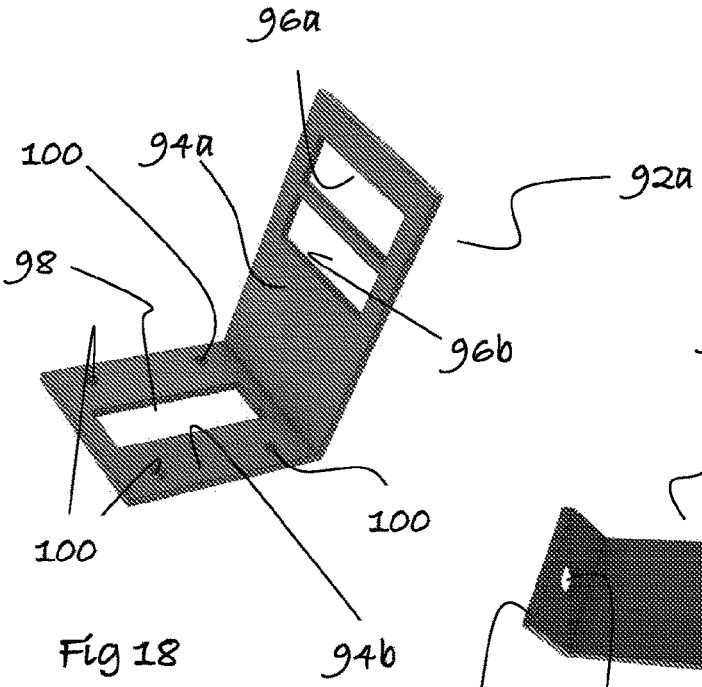
FIG. 18 shows a perspective view of a first holding bracket of the bracket system in accordance with the present embodiment of the invention.
Figure 19:
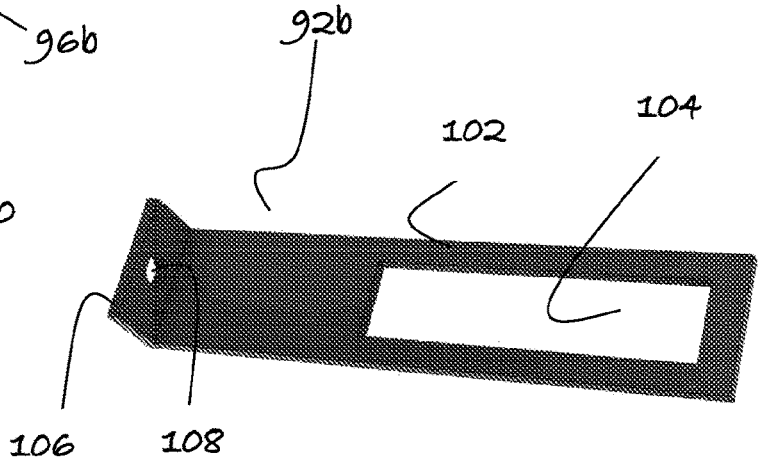
FIG. 19 shows a perspective view of the second holding bracket the bracket system.

FIGS. 18 and 19 show particular arrangements of the holding brackets 92*a* and 92*b*.

FIG. 18 shows a first holding bracket 92*a*. The first holding bracket 92*a* comprises a body having two sheets 94 perpendicularly connected to each other. A first sheet 94*a* comprises a plurality of slots 96 extending transversally on the first sheet 94*a*. The slots 96 are located side by side opposite to where the two sheets 94 join together. A second sheet 94*b* comprises a slot 98 centred in the sheet 94*b* and extending longitudinally along the second sheet 94*b*. The second sheet also comprises openings 100 at each corner of the sheet 94*a*.

The second sheet 94*b*, as will be described with reference to the method of installation and operation of the bracket system 91, is adapted, via the openings 100, to be attached to the rear surface of the cladding 50 that will be covering either the wall 14 or wall 16 of the storage unit 12. The slot 98 permits varying the location of the first holding bracket 92*a* when abutting the wall 16 to account for any variation in the location of the counterpart fastening means 54 due to the intrinsic deficiencies of the rotational moulding manufacturing process described above.

The first sheet 94*a*, comprising the plurality of slots 96, is adapted to abut the wall 14 (as shown in FIG. 17) for attachment of the first holding bracket 92*a* to the side wall 14 via fastenings means traversing any of the slots 96 (for example, the slot 96*b* as shown in FIG. 17).

Figure 13:
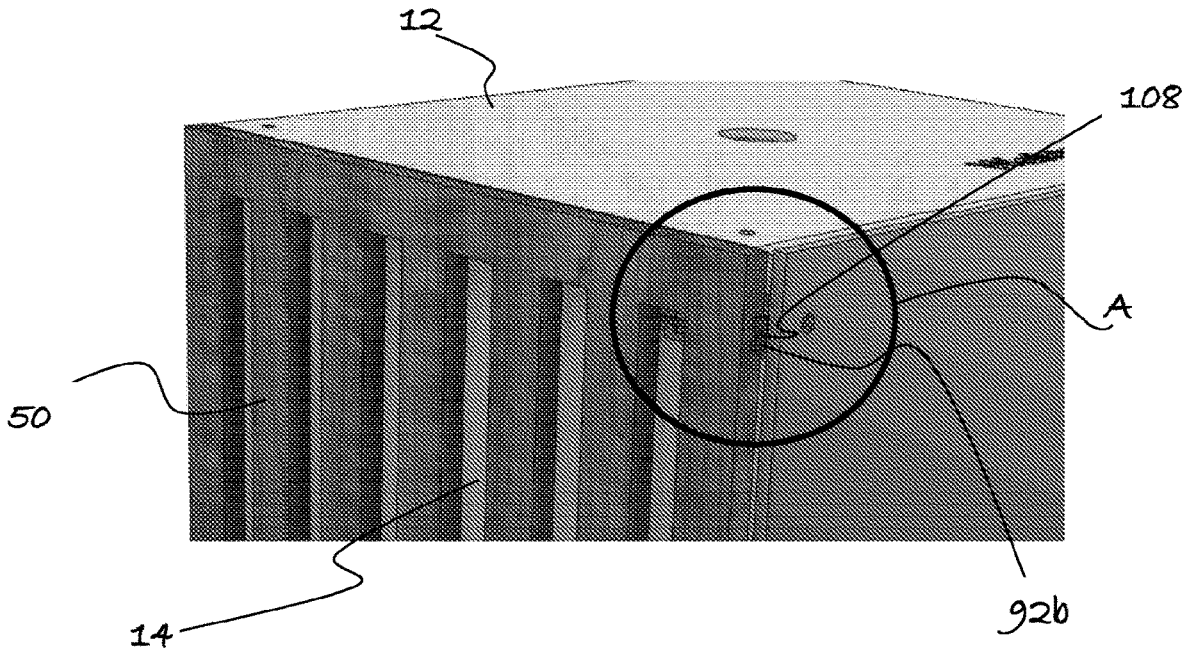
FIG. 13 is a perspective view of an end portion of the storage unit shown in FIG. 1 comprising cladding on its faces attached via a bracket system in accordance with the present embodiment of the invention.
Figure 16:
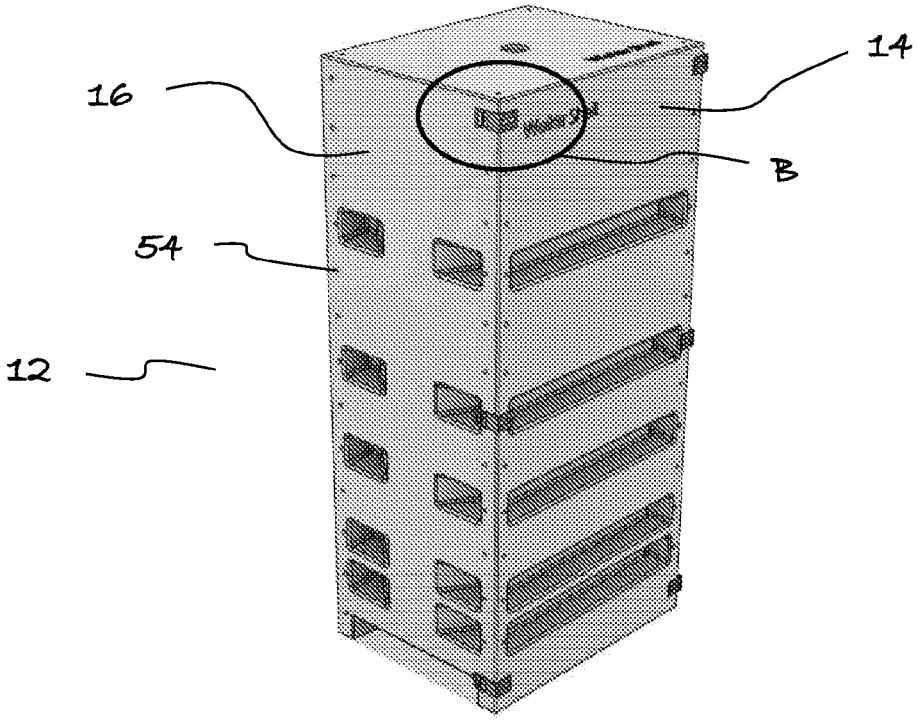
FIG. 16 is a perspective view of the storage unit shown in FIG. 13 with the cladding removed from the storage unit exposing first holding brackets of the bracket system exposed in FIG. 15 in accordance with the present embodiment of the invention.

By attaching the first holding bracket 92*a* to the side wall 14, the cladding 50 may be attached to the wall 16 as is shown in, for example, in FIG. 13. In particular, as described above, it is possible to attach the cladding 50 to the wall 16 (as shown in FIG. 15) by using a plurality of first holding brackets 92*a* as shown in FIG. 16.

Figure 14:
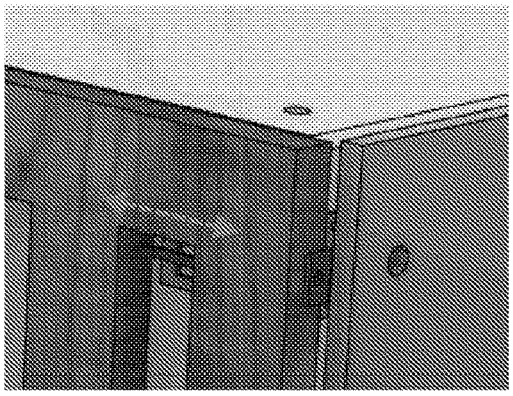
FIG. 14 shows a close-up of detail A shown in FIG. 13.

The second holding bracket 92*b* allows for attachment of cladding 50 to the wall 14 as is shown in FIGS. 13 and 14. In particular, as shown in FIG. 19, the second holding bracket 92*b* comprises a first sheet 102 having a slot 104 extending longitudinally along the first sheet 102, and a second sheet 106 comprising a centre opening 108.

As will be described with reference to the method of installation and operation of the bracket system 91, the second sheet 106 and the opening 108 permits attaching the cladding 50 to the second holding bracket 92*b* as is shown in FIGS. 13 and 14. By using a fastening means such as a screw, the second holding bracket 92*b* is attached to the cladding 50 such that the first sheet 102 abuts the inner surface of the cladding 50 and faces the wall 14 of the storage unit 12 for entering in contact with the first sheet 94*a* (of the first holding bracket 92*a*) as is shown in FIG. 15 wherein the cladding 50 has been removed to expose the bracket system 91 in accordance with the present embodiment of the invention. Attachment of the first and second brackets 92 allows for attaching the cladding 50 to the wall 14 by locating a plurality of second holding brackets 92*a* against the plurality of first holding brackets 92*a* as is shown in FIG. 16.

In the arrangement as shown in FIG. 15, one side (the right side) of the wall 14 comprises the first sheet 94*a* (the one that includes the plurality of slots 96) of the first holding bracket 92*a* and the other side of the wall 14 (the left side) comprises the second sheet 94*b* (the one that includes the single slot 98) of the first holding bracket 92*a*.

For attachment of the second holding brackets 92 to the wall 14, each second holding bracket 92 abuts the first sheet 94*a*; and using a fastening means such as a screw, each second holding bracket 92 is attached to the wall 14 by screwing the screw into the counterpart fastening means 54. The cladding 50 (for covering wall 14) is then attached once all of the bracket systems 91 (required for securely attached the claddings 50 the walls 14 and 16) have been installed on the storage unit 12.

The bracket system 91 is particularly advantageous because it comprises a pair of holding bracket 92 which when attached together permit displacing the first and second holding brackets 92*a* and 92*b* horizontally and vertically by sliding the holding brackets 92 over the surfaces of the walls 14 and 16. In this manner, it is possible to properly attach the cladding 50 to the storage unit 12 even though the counterpart fastening means 54 may not have been properly positioned during manufacturing of the storage unit 12.

The above is possible because the holding brackets 92 comprises the slots 96, 98 and 104 which permits displacing (as illustrated by the arrows in FIGS. 14, 15 and 17) the holding brackets 92 prior attaching them via fastening means (such as screws) and the counterpart fastening to account for the variations in the locations of the counterpart fastening means 54. This is possible because the first holding bracket 92 comprises the vertical slots 96 and the horizontal slot 98, which permit moving the first holding bracket 92*a* in order to be able to attach the first holding bracket 92*a* to the storage unit 12. Similarly, the second holding bracket 92*b* comprises a horizonal slot 104 so that the second holding bracket 92*b* may slide so that the cladding 50 attached to the wall 14 (the side facing cladding 50) may juxtapose with the edge of the cladding 50 attached to the wall 16 (the front facing cladding 50).

Furthermore, the first holding bracket 92*a* permits defining a clearance between the cladding 50 and the front face of the walls 14 and 16 of the storage unit 12. This is particularly advantageous because the clearance 110 (see FIG. 15) prevents any facial deformation of the walls of the storage unit 12 due to hydrostatic loading to be transmitted to the cladding.

Modifications and variations as would be apparent to a skilled addressee are deemed to be within the scope of the present invention.

Further, it should be appreciated that the scope of the invention is not limited to the scope of the embodiments disclosed. By way of example, the apparatus and method according to the invention may be suitable.

The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

Throughout this specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A storage unit having a body comprising an outer frame defining an inner space, and a plurality of portions located within the inner space, wherein the plurality of portions are adapted to be attached to each other providing reinforcement to wall structures of the outer frame, wherein attachment between the plurality of portions of the outer frame occurs via kiss-off features, the outer frame comprises end walls and side walls defining the wall structures, and a bottom and a roof defining the inner space, wherein the plurality of portions comprise indentations indenting into the wall structures of the outer frame and the plurality of portions comprise a first set of indentations indenting into the side walls, and a second set of indentations indenting into the end walls, wherein indentations of the first set of indentations comprises first ends located within the outer frame and indentations of the second sets of indentations comprises second ends located within the outer frame, wherein the first ends and the second ends define counterpart ends that are bridged together during casting forming the kiss-off features.

2. The storage unit according to claim 1, wherein the kiss-off features are formed during casting by powdered plastic material bridging one or more gaps between the plurality of portions of the outer frame.

3. The storage unit according to claim 1, wherein the first set of indentations comprise rectangular parallelepipeds.

4. The storage unit according to claim 1, wherein the first set of indentations comprise a plurality of rectangular parallelepipeds arranged in a spaced apart relationship with respect to each other along the side wall.

5. The storage unit according to claim 4, wherein there are pairs of rectangular parallelepipeds spaced apart a particular spacing with respect to each other.

6. The storage unit according to claim 5, wherein the spacing for one pair of rectangular parallelepipeds is not the same spacing as the spacing of another pair of rectangular parallelepipeds.

7. The storage unit according to claim 6, wherein the one pair of rectangular parallelepipeds is arranged with respect to the another pair of rectangular parallelepipeds in such a manner so as to provide an enhanced reinforcement.

8. The storage unit according to claim 1, wherein the second set of indentations comprise a plurality of trapezohedrons arranged in a spaced apart relationship with respect to each other along the side wall.

9. The storage unit according to claim 8, wherein there are pairs of the trapezohedrons spaced apart at particular spacing with respect to each other.

10. The storage unit according to claim 9, wherein the spacing for one pair of the trapezohedrons is not the same spacing as the spacing of another pair of the trapezohedrons.

11. The storage unit according to claim 10, wherein the one pair of trapezohedrons are arranged with respect to the another pair of trapezohedrons in such a manner so as to provide an enhanced reinforcement.

12. The storage unit according to claim 1, wherein the storage unit is adapted to be fluidly connected to an exterior source of fluid.

13. The storage unit according to claim 1, wherein the storage unit is adapted to be fluidly connected to one or more other storage units.

14. The storage unit according to claim 1, wherein the storage unit further comprises a piping system for fluidly connecting neighbouring storage units.

15. The storage unit according to claim 14, wherein the storage unit further comprises one or more recesses for receiving the piping system.

16. The storage unit according to claim 15, wherein the recesses are located at the bottom of the storage unit.

17. The storage unit according to claim 1, wherein the storage unit comprises cladding covering the side and end walls.

18. The storage unit according to claim 1, wherein the storage unit comprises a roof structure.

19. The storage unit according to claim 1, wherein the body of the storage unit is casted in a rotational mould.

20. A storage unit having a body comprising an outer frame defining an inner space, and a plurality of portions located within the inner space, wherein the plurality of portions are adapted to be attached to each other providing reinforcement to wall structures of the outer frame, wherein attachment between the plurality of portions of the outer frame occurs via kiss-off features, the outer frame comprises end walls and side walls defining the wall structures, and a bottom and a roof defining the inner space, wherein the plurality of portions comprise indentations indenting into the wall structures of the outer frame and the plurality of portions comprise a first set of indentations indenting into the side walls, and a second set of indentations indenting into the end walls, wherein the second set of indentations comprise trapezohedrons.

21. A storage unit having a body comprising an outer frame defining an inner space, and a plurality of portions located within the inner space, wherein the plurality of portions are adapted to be attached to each other providing reinforcement to wall structures of the outer frame, wherein attachment between the plurality of portions of the outer frame occurs via kiss-off features, the outer frame comprises end walls and side walls defining the wall structures, and a bottom and a roof defining the inner space, wherein the wall structures and the roof comprise indentations extending into the inner space, wherein the indentations define counterpart fastening means for receiving fastening means.

22. The storage unit according to claim 21, wherein the indentations are defined within a mould during casting of the body of the storage unit via protrusions extending from inner surfaces of the mould.

23. A storage system comprising one or more of the storage units of claim 1, wherein each of the storage units further comprises a piping system for fluidly connecting to a neighbouring one of the storage units.

24. The storage system according to claim 23, wherein each storage unit further comprises one or more recesses for receiving the piping system.

25. The storage system according to claim 24, wherein the recesses are located at the bottom of each storage unit.

* * * * *